US007748565B2

(12) United States Patent
Anvieh

(10) Patent No.: US 7,748,565 B2
(45) Date of Patent: Jul. 6, 2010

(54) AUTOMATIC DISPENSING APPARATUS

(76) Inventor: Hannibal Anvieh, 19807 Enadia Way, Winnetka, CA (US) 91306

( * ) Notice: Subject to any disclaimer, the term of this patent is extended or adjusted under 35 U.S.C. 154(b) by 592 days.

(21) Appl. No.: 11/704,063

(22) Filed: Feb. 7, 2007

(65) Prior Publication Data

US 2008/0185397 A1 Aug. 7, 2008

(51) Int. Cl.
*B65D 35/28* (2006.01)

(52) U.S. Cl. ..... 222/52; 222/63; 222/96; 222/504; 141/361; 251/208

(58) Field of Classification Search ..... 222/1, 222/52, 63, 638, 642, 643, 93, 95, 96, 103, 222/105, 504; 141/351, 360, 361, 362; 251/205, 251/208

See application file for complete search history.

(56) References Cited

U.S. PATENT DOCUMENTS 2,411,923 A * 12/1946 Kotraba ..... 141/267
2,633,271 A * 3/1953 Bryant ..... 141/234
3,198,389 A * 8/1965 Dunning ..... 222/93
4,234,104 A * 11/1980 Apuzzo et al. ..... 222/94
4,418,840 A * 12/1983 Gardner, Sr. ..... 222/96
5,050,773 A * 9/1991 Choi ..... 222/63
5,199,610 A * 4/1993 Gagliardi ..... 222/101
5,215,218 A * 6/1993 Choi ..... 222/63
5,400,839 A * 3/1995 Cravett ..... 141/362
6,364,165 B2 * 4/2002 Sampson et al. ..... 222/102
6,880,726 B1 * 4/2005 Perez ..... 222/102
6,968,977 B1 * 11/2005 Beene ..... 222/101
D557,960 S * 12/2007 Makowsky ..... D6/541
7,520,407 B2 * 4/2009 Crosby et al. ..... 222/102

* cited by examiner

*Primary Examiner*—Kevin P Shaver
*Assistant Examiner*—Donnell Long
(74) *Attorney, Agent, or Firm*—Tope-McKay & Associates; Marcus Risso

(57) ABSTRACT

Described is an automatic dispensing apparatus for dispensing toothpaste. The dispensing apparatus comprises a housing having a front portion with a hole therethrough. The housing is capable of holding a tube of toothpaste. A sensor is attached with the housing. A spring is connectable with the housing for compressing the container of the viscous substance. A dispenser head is attached with the housing for attaching with the container of the viscous substance. Additionally, a motor is connected with the sensor and the dispenser head. Thus, a user can activate the sensor by placing an object proximate the sensor to activate the motor so that the motor rotates the dispenser head. In operation, the spring compresses the tube of toothpaste such that the toothpaste is pressed out of the container and through the dispenser head and the hole in the front portion of the housing to be dispensed upon a toothbrush.

19 Claims, 7 Drawing Sheets

AUTOMATIC DISPENSING APPARATUS

BACKGROUND OF THE INVENTION (1) Technical Field

The present invention relates to the field of automatic dispensers and, more specifically, to an automatic toothpaste dispensing apparatus.

(2) Background

Toothpaste dispensers are well known in the art. Many existing toothpaste dispensers are in the form of simple tubes that dispense toothpaste when users manually squeeze the tubes. Alternatively, some toothpaste dispensers exist in a pump form. Using a pump dispenser, a user can manually dispense the toothpaste by depressing a lever on the pump.

Such forms of toothpaste dispensers are not user-friendly because they require a person to grip and squeeze a tube or pump. As such, dispensers that require the manual dispensing of toothpaste may be difficult to operate for people with arthritis or with a small amount of hand strength.

Additionally, traditional tube and pump toothpaste dispensers are often messy. It is easy to squeeze a tube of toothpaste or pump a toothpaste dispenser with an incorrect amount of pressure (or for an incorrect length of time) so that an incorrect amount of toothpaste dispenses on or about the toothbrush. Also, traditional forms of tube and pump toothpaste dispensers often come with caps that become messy and covered with toothpaste. The toothpaste in the dispenser may also dry out if a person accidentally leaves the cap off of the toothpaste dispenser. Thus, existing toothpaste dispensers are inconvenient because they are both messy and difficult to handle.

On the other hand, an automatic toothpaste dispenser that can dispense toothpaste without manual operation, because of its ease of use, can encourage children and adults to brush their teeth more often. In this respect, automatic toothpaste dispensers will promote oral hygiene and better health.

Another setback of traditional toothpaste dispensers is that they are not aesthetically pleasing. The tubes or pumps, often covered with toothpaste, do not add to but rather detract from the décor of the bathroom.

Therefore, what is needed is an aesthetically pleasing, automatic toothpaste dispenser that can dispense a correct amount of toothpaste with ease and without making a mess.

SUMMARY OF THE INVENTION

The present invention relates to an automatic dispensing apparatus. In particular, an automatic dispensing apparatus that dispenses toothpaste. However, the invention is not limited to the dispensing of toothpaste but also includes the dispensing of a variety of viscous substances.

The automatic toothpaste dispensing apparatus is comprised of a housing that can hold a tube of toothpaste within it. In one embodiment, the tube of toothpaste is compressed by a source of pressure, or compression apparatus, such as a spring. In this embodiment, a spring that is located at the back of the apparatus exerts a constant pressure, compresses the tube of toothpaste, and pushes the toothpaste out of the tube and into a dispenser head that is attached to the tube and located at the front portion of the apparatus. As a non-limiting example, the dispenser head is comprised of a rotating cylinder with a diagonal and continuous opening which directs the flow of toothpaste in a straight line from the dispenser head to the outside of the automatic dispensing apparatus, and onto a toothbrush.

Also located on the front portion of the apparatus is a sensor component that activates a motor unit within the housing of the automatic dispensing apparatus. When a person places an object, such as a toothbrush, in front of the sensor component, the sensor component detects the object and activates the motor unit. The motor unit then powers the rotation of a rotating cylinder of the dispenser head. The motor unit may be powered by an external power source, via an AC power adapter, or by an internalized power source, such as a battery.

When activated by the motor unit, the dispenser head rotates so that the diagonal and continuous opening of its rotating cylinder lines up with a hole in the outer shell of the dispenser head, or alternatively, the opening can line up with a hole in the housing of the automatic dispensing apparatus, to allow the toothpaste to flow out of the apparatus. The dispenser head thereby releases the pressure that the compression apparatus, e.g. a spring, is constantly exerting on a tube of toothpaste. When some of the pressure inside the tube of toothpaste is released, the toothpaste will flow from the inside the tube held within the housing, through the dispenser head, out of the hole on the front portion of the housing, and onto the toothbrush that is located in front of the sensor component and outside of the housing.

Because the dispenser head comprises a rotating cylinder with a diagonal and continuous opening, it allows for dispensing varying quantities of toothpaste. The dispenser head will dispense different amounts of toothpaste based on the length of time an object is placed in front of the sensor component. In one embodiment, a switch is located on the outside of the housing of the apparatus that manually sets the length of time that the dispenser head is used and thus the amount of toothpaste dispensed. Alternatively, a user can depress a button for a certain length of time to control the amount of toothpaste dispensed, rather than using a switch that dispenses a set amount of toothpaste.

Alternatively, a pressurized tube or pressurized can of toothpaste is inserted into the automatic dispensing apparatus. The tube or can of toothpaste has a lid that is punctured when the lid is turned to a lock position within the housing of the automatic dispensing apparatus. Upon puncturing the tube or can of toothpaste, some of the internalized pressure is released and the toothpaste will flow into the dispenser head. This design eliminates the need for a spring.

In one aspect of the present invention, the sensor component is an electronic eye that activates the motor unit when it detects objects that are placed in front of it.

In another aspect of the present invention, the sensor component is a button that activates the motor unit when it is depressed.

In a further aspect of the present invention, the housing that surrounds the automatic dispensing apparatus comprised of a waterproof material.

In still another aspect of the present invention, the housing surrounding the automatic dispensing apparatus is in the form of a decorative shape such as a house, car, or nightlight.

In a yet a further aspect of the present invention, the housing includes a toothbrush holder.

Finally, as can be appreciated by one in the art, the present invention also comprises a method for forming and using the automatic dispensing apparatus described herein.

BRIEF DESCRIPTION OF THE DRAWINGS

The objects, features and advantages of the present invention will be apparent from the following detailed descriptions of the disclosed aspects of the invention in conjunction with reference to the following drawings, where.

DETAILED DESCRIPTION

Figure 1:
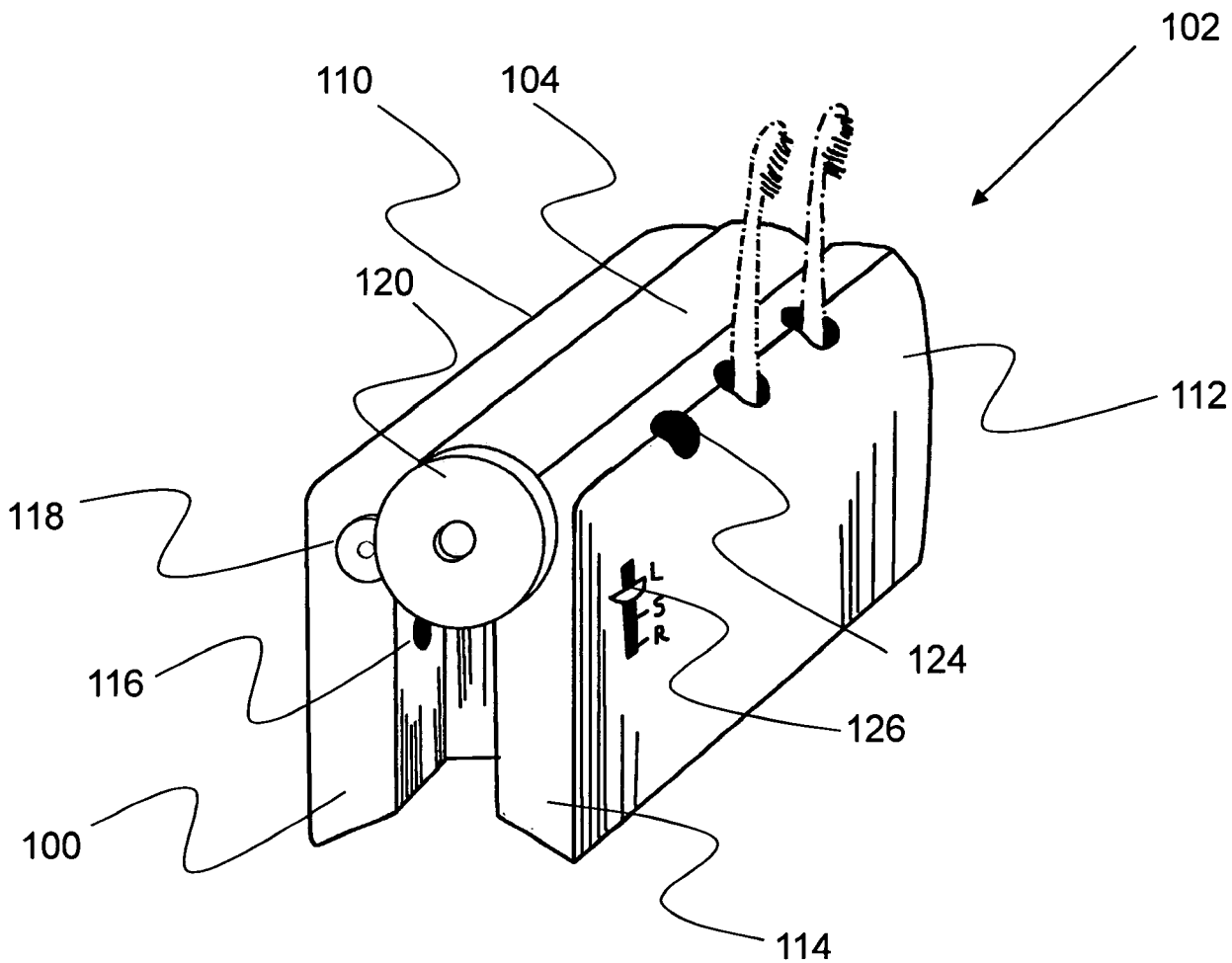
FIG. 1 is a front perspective view of an automatic dispensing apparatus in accordance with the present invention.

The present invention relates to an automatic dispensing apparatus and, more particularly, to an automatic toothpaste dispenser. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein. Furthermore, it should be noted that unless explicitly stated otherwise, the figures included herein are illustrated diagrammatically and without any specific scale, as they are provided as qualitative illustrations of the concept of the present invention.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in an illustrative form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Details

The present invention relates to an automatic dispensing apparatus. In particular, the automatic dispensing apparatus dispenses toothpaste. However, the invention is not limited to the dispensing of toothpaste but also includes the dispensing of a variety of viscous substances.

As illustrated in FIG. 1, a housing 100 of an automatic dispensing apparatus 102 includes a compartment 104 located in between a left side 110 and right side 112 of the automatic dispensing apparatus 102. A tube or can of toothpaste or another viscous substance may be inserted within the compartment 104. Also shown in FIG. 1, on a front portion 114 of the automatic dispensing apparatus 102 is a sensor component 116, for example, an electronic eye as shown. The sensor component 116 is any suitable mechanism or device for sensing the presence of an object (e.g., toothbrush), a non-limiting example of which includes a motion sensor and a light sensor. The sensor component 116 activates a motor unit 118 that can rotate a dispenser head 120. Upon rotation, toothpaste or another substance may be dispensed through the dispenser head 120.

FIG. 1 illustrates the right side 112 of the automatic dispensing apparatus 102 as having a plurality of holes 124 for holding toothbrushes therein. Also located on the right side 112 of the automatic dispensing apparatus 102 is a controller 126 which can be set to different levels to dispense different amounts of toothpaste. Although illustrated as being located on the right side 112 of the automatic dispensing apparatus 102, as can be appreciated by one skilled in the art, the holes 124 and controller 126 can be formed at any suitable location to facilitate their respective functions. When an object is placed in front of the sensor component 116, the motor unit 118 is configured to rotate the dispenser head for a certain amount of time to dispense a certain amount of toothpaste. For example, when the controller 126 is set to "L," the automatic dispensing apparatus 102 will activate the dispenser head 120 for a certain amount of time to supply the amount of toothpaste appropriate for a long toothbrush head. When the controller 126 is set to "S" for a small toothbrush head or "R" for a round toothbrush head, the automatic dispensing apparatus 102 will activate the dispenser head 120 for a certain amount of time to supply the amount of toothpaste appropriate for a short or round toothbrush head, respectively. Thus, controller 126 controls the amount of time that the motor unit 118 is engaged (activated). For example, when the controller 126 is set to "L," the motor unit is engaged for a longer amount of time than when the controller 126 is set to "S," thereby allowing for a larger amount of toothpaste to be dispensed. Although the controller 126 is depicted as a switching mechanism, as can be appreciated by one skilled in the art, the controller 126 is any suitable mechanism or device for allowing a user to selectively control the amount of time the motor unit 118 is engaged. Additional non-limiting examples include buttons and a digital control.

Figure 2:
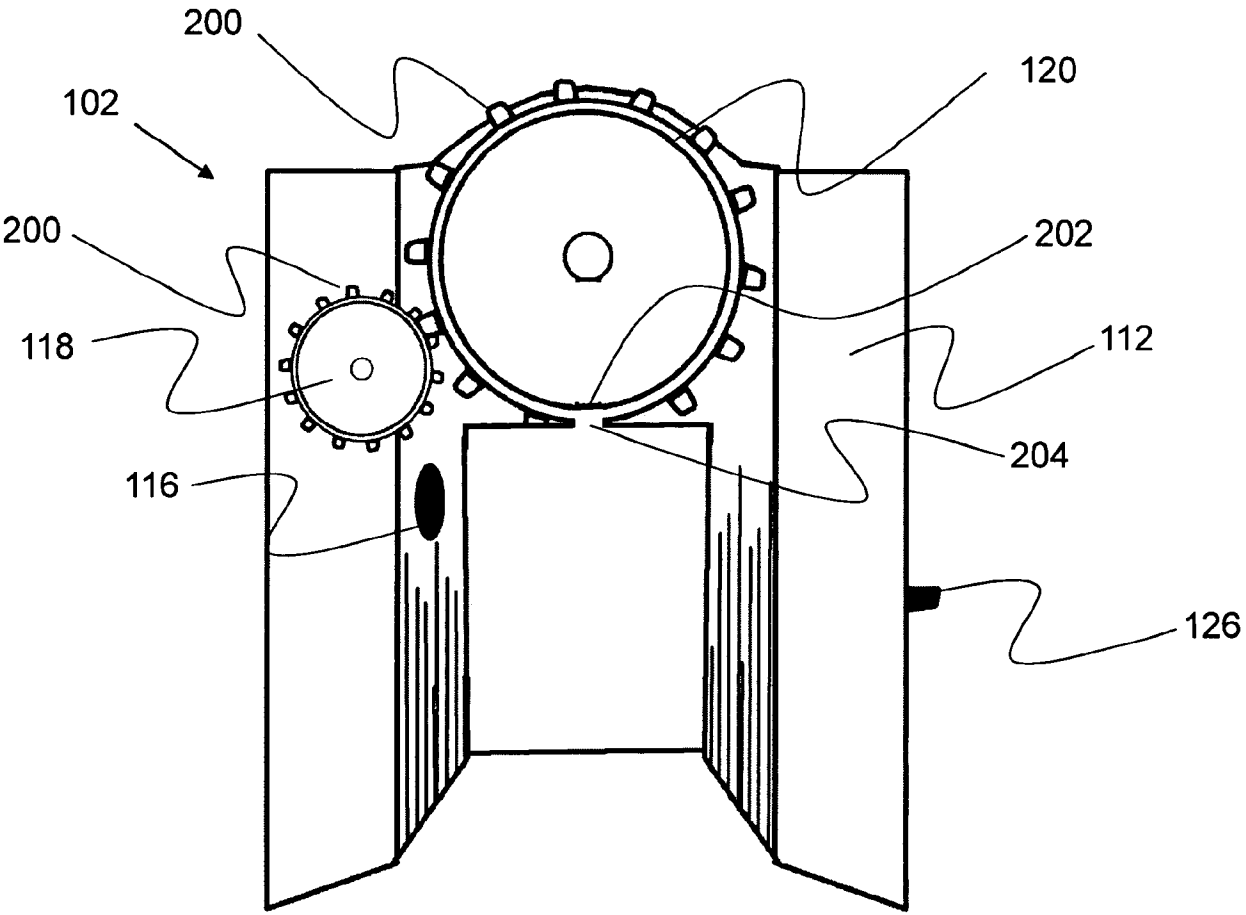
FIG. 2 is a front elevational view of an automatic dispensing apparatus in accordance with the present invention.

FIG. 2 illustrates a front view of the automatic dispensing apparatus 102. In this illustration, both the motor unit 118 and the dispenser head 120 include a connection apparatus for interlinking the motor unit 118 with the dispenser head 120. The connection apparatus is any suitable mechanism or device for making such a connection. As a non-limiting example, both the motor unit 118 and the dispenser head 120 include teeth portions 200 that are capable of interlinking with each other so that the motor unit 118 can control and turn the dispenser head 120 when it is activated by the sensor component 116. When rotated, the dispenser head 120 directs the flow of toothpaste that is stored in the dispenser head 120 through a continuous opening 202 that lines up with a corresponding hole 204 in the automatic dispensing apparatus 102 to release the toothpaste out of the automatic dispensing apparatus 102. The controller 126 that controls the amount of toothpaste dispensed is again located on the right side 112 (although not limited thereto) of the automatic dispensing apparatus 102 in this illustration.

Figure 3:
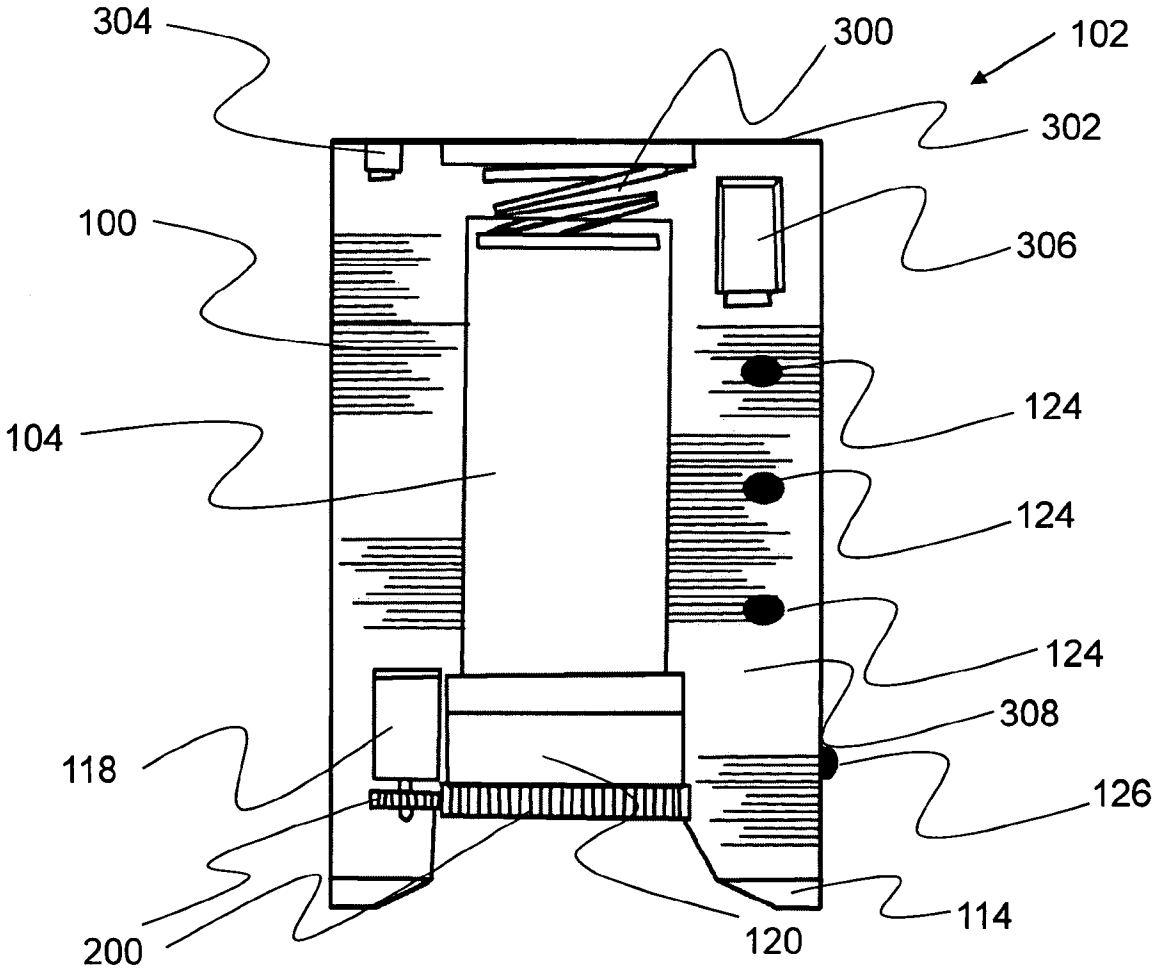
FIG. 3 is a top view of an automatic dispensing apparatus in accordance with the present invention.

The top view of the automatic dispensing apparatus 102 is shown in FIG. 3. As shown in FIG. 3, the automatic dispensing apparatus 102 includes a compression apparatus 300 located on a back 302 of the automatic dispensing apparatus 102 which is capable of exerting a constant pressure on an object that is placed within the compartment 104 of the housing 100. For example, the pressure can compress the tube of toothpaste, with the toothpaste then being pushed out of the tube and into a dispenser head 120 located proximate the front portion 114 of the automatic dispensing apparatus 102.

FIG. 3 also illustrates the teeth portions 200 located on the motor unit 118 and dispenser head 120 that allow for the motor unit 118 to control the rotation of the dispenser head 120. As shown in FIG. 3, a plurality of holes 124 is located on the top 308 of the automatic dispensing apparatus 102. The holes 124 are formed such that they are capable of supporting toothbrushes proximate to or within the housing 100 of the automatic dispensing apparatus 102. The controller 126 that sets the length of time that the toothpaste will be dispensed, and thus the amount of toothpaste dispensed, is visible from the top view of the automatic dispensing apparatus 102 as well. However, as can be appreciated by one skilled in the art, other forms and locations of the controller 126 are not necessarily visible from the top view.

FIG. 3 illustrates an embodiment of the automatic dispensing apparatus 102 having two alternative sources to power the automatic dispensing apparatus 102, including an AC power adapter 304 to accept an external power source and a battery 306.

Figure 4:
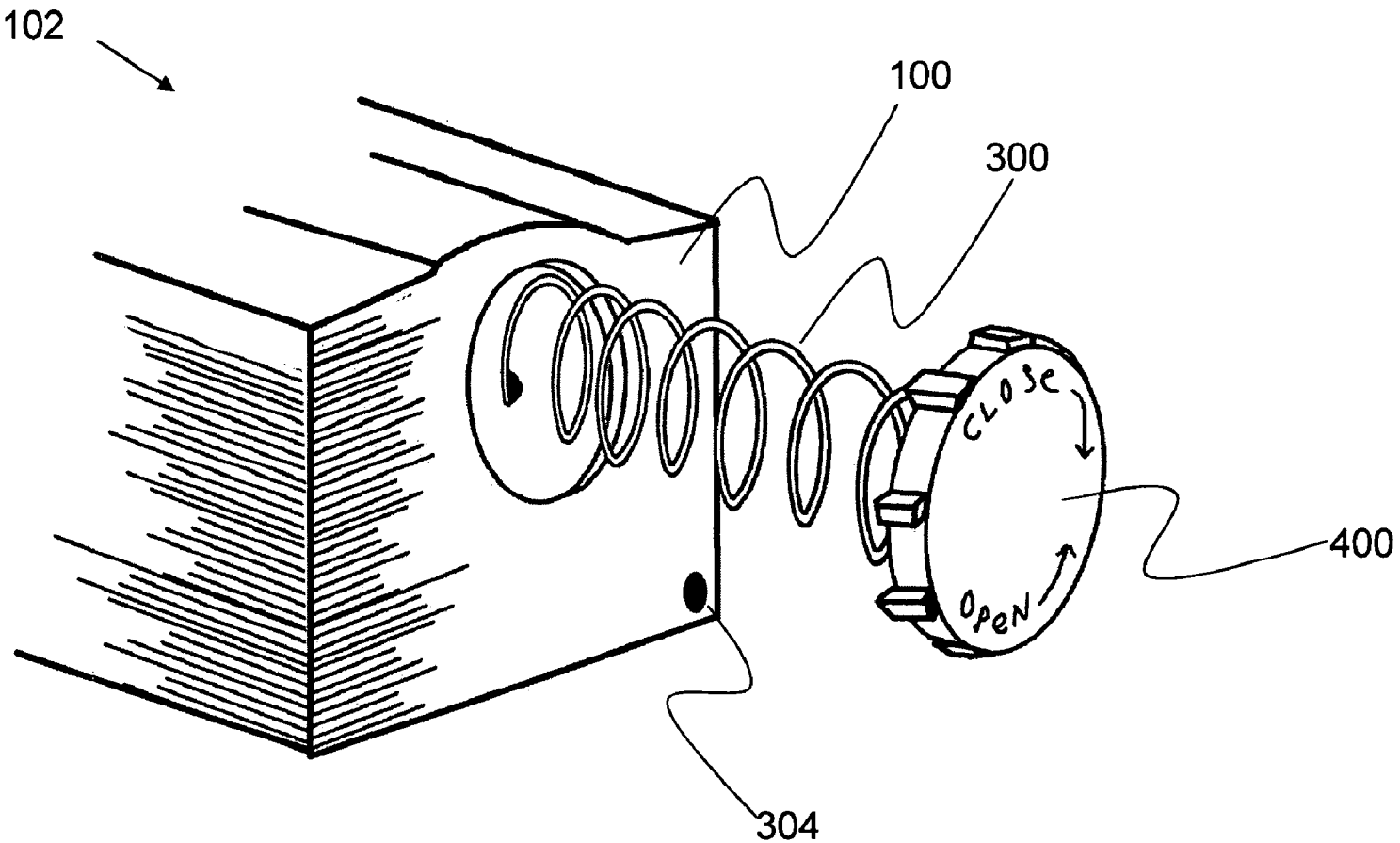
FIG. 4 is a back perspective view of an automatic dispensing apparatus in accordance with the present invention.

FIG. 4 shows a back view of the automatic dispensing apparatus 102. A compression apparatus 300 is connectable with the housing 100 to exert a constant pressure and compress a tube of toothpaste so that the toothpaste will be pushed to and dispensed from the opposite, front portion (illustrated in FIG. 1) of the automatic dispensing apparatus 102. The compression apparatus 300 is any suitable mechanism or device for compressing a tube of toothpaste. For example, the compression apparatus 300 includes a spring that may be inserted into the housing 100 of the automatic dispensing apparatus 102. As another non-limiting example, the compression apparatus 300 can be a pressurized tube or can of toothpaste. The compression apparatus 300 may be removed from the housing 100 by twisting a handle 400 attached with the compression apparatus 300. An AC power adapter 304 is shown in FIG. 4 as an inlet for an external power source for the automatic dispensing apparatus 102.

Figure 5:
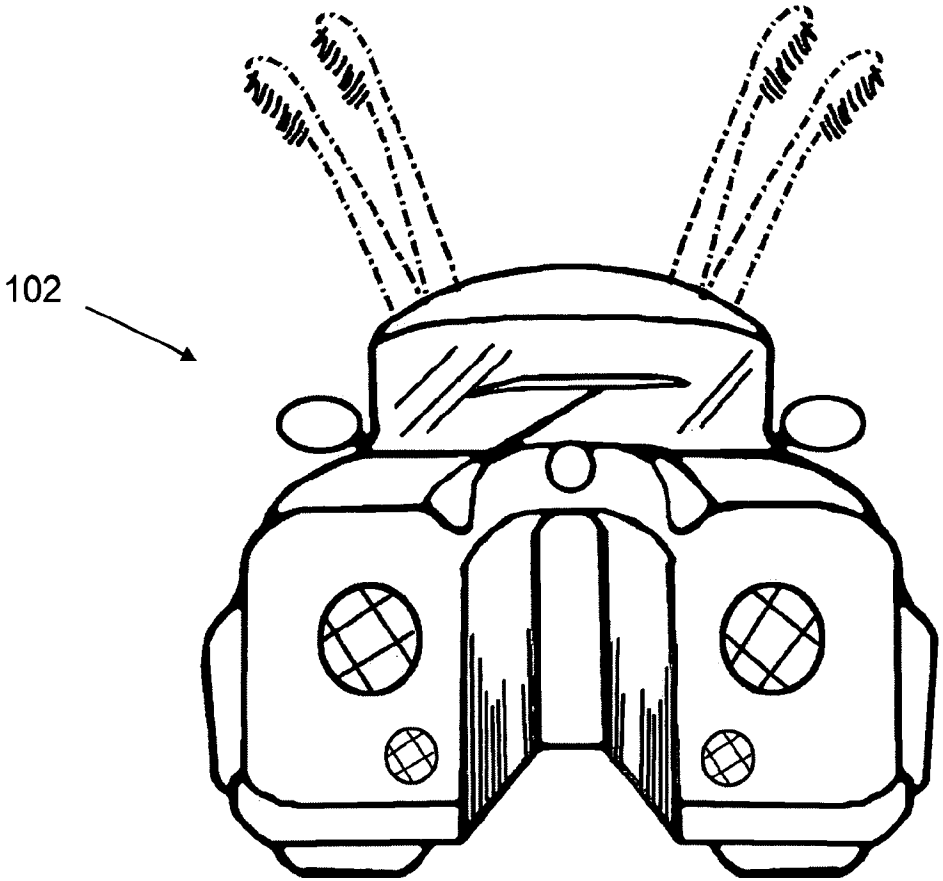
FIG. 5 is a front perspective view of an automatic dispensing apparatus in accordance with the present invention, depicting a dispenser in the shape of a car.

To increase the aesthetics and enjoyment by a user, the automatic dispensing apparatus 102 and its housing 100 can be formed to represent a variety of desirable shapes. As a non-limiting example and as illustrated in FIG. 5, the automatic dispensing apparatus 102 may be in the shape of a car. FIG. 5 illustrates the front view of a car embodiment. Again, the automatic dispensing apparatus 102 is capable of storing toothbrushes. As can be appreciated by one skilled in the art, the automatic dispensing apparatus 102 may be in alternative shapes, including but not limited to, a house, a soccer ball, or a nightlight.

Figure 6:
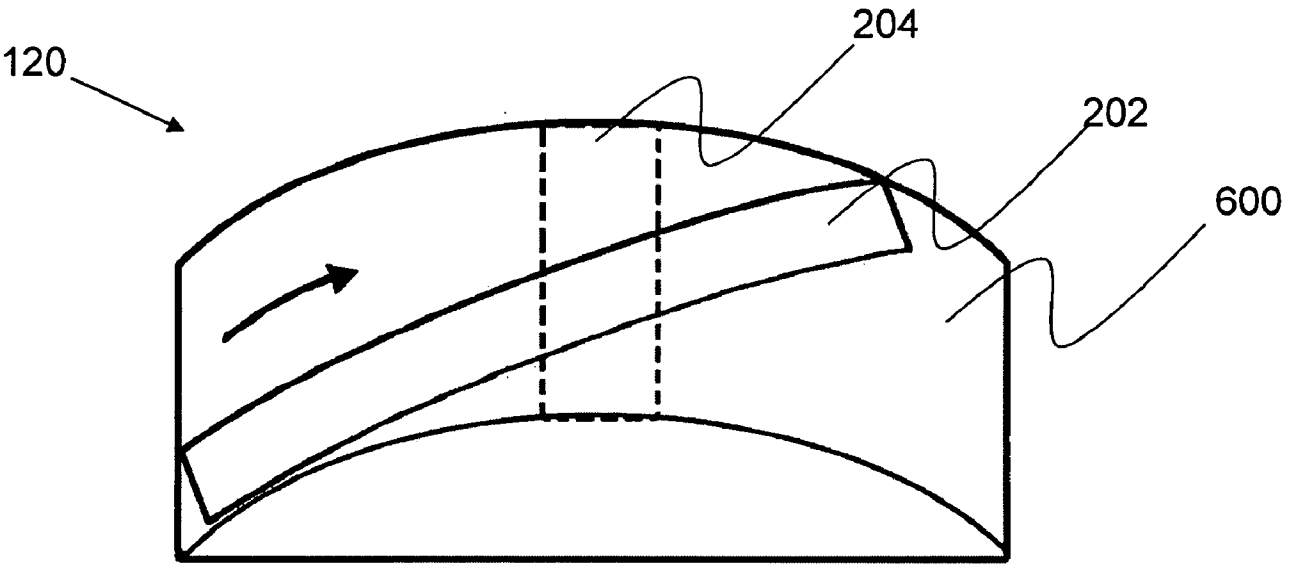
FIG. 6 is a bottom perspective view of a dispenser head having a rotating cylinder with a diagonal and continuous opening in accordance with the present invention.

FIG. 6 shows a bottom view of the dispenser head 120 having a rotating cylinder 600 with a diagonal and continuous opening 202. When activated, the dispenser head 120 rotates so that the diagonal and continuous opening 202 of its rotating cylinder 600 lines up with a hole 204 in the automatic dispensing apparatus (illustrated in FIG. 2) to direct flow of the toothpaste out of the automatic dispensing apparatus.

Figure 7:
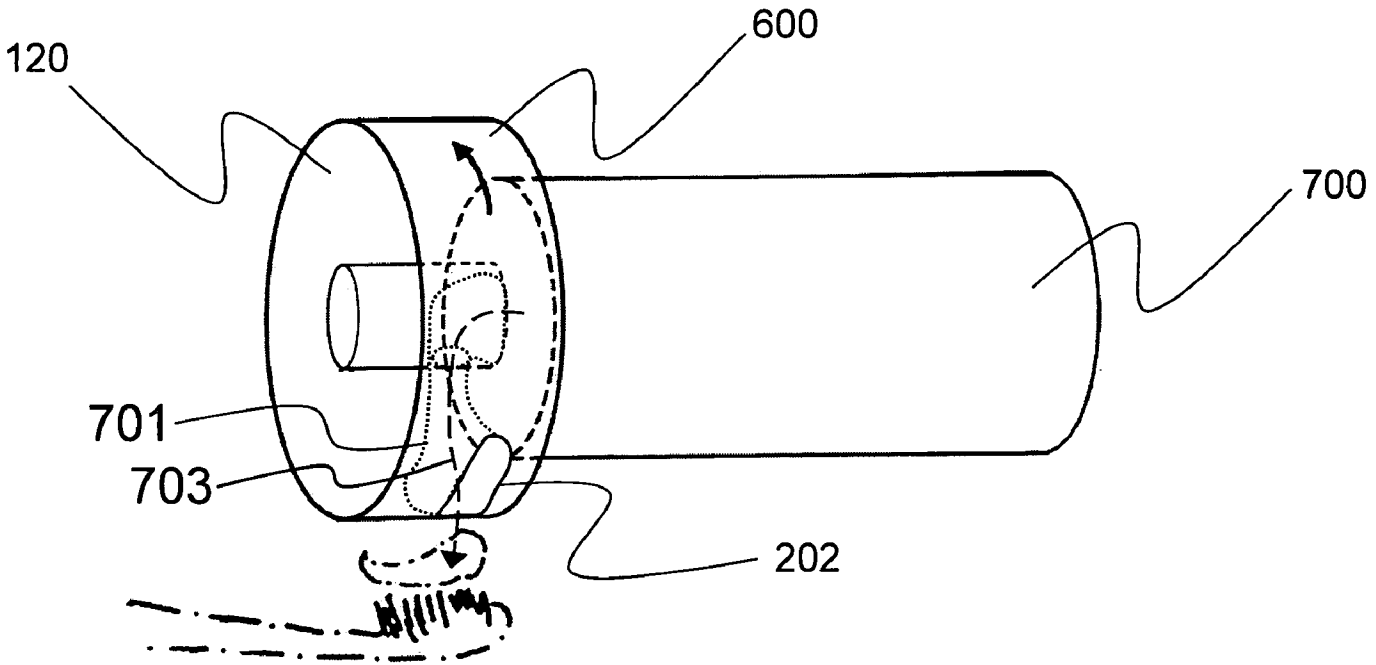
FIG. 7 is a side perspective view of a dispenser head with a diagonal and continuous opening in accordance with the present invention.

FIG. 7 illustrates a side view of the dispenser head 120. As described above, the dispenser head 120 comprises a rotating cylinder 600 with a diagonal and continuous opening 202. The dispenser head 120 is used to attach with a container 700 of a viscous substance that can be placed in the compartment of the automatic dispensing apparatus (illustrated in FIG. 1). The dispenser head 120 is formed such that a cavity or channel 701 exists between the container 700 and the continuous opening 202, thereby allowing for the travel 703 of toothpaste therebetween. In operation, the dispenser head 120 is filled with toothpaste received from the container 700. When activated, the dispenser head 120 rotates so that the diagonal and continuous opening 202 of the rotating cylinder 600 directs the flow of toothpaste out of the automatic dispensing apparatus (as illustrated in FIG. 2).

What is claimed is:

1. An automatic dispensing apparatus, comprising:

a housing having a front portion, wherein the housing is capable of holding a container of a viscous substance proximate to the front portion, and the front portion further comprising a hole therethrough;

a sensor component attached with the front portion of the housing;

a compression apparatus that is connectable with the housing, the compression apparatus being operative for compressing the container of the viscous substance;

a dispenser head attached with the housing proximate the front portion, wherein the dispenser head is capable of attaching with the container of the viscous substance; and a motor unit connected with the sensor component and the dispenser head, whereby a user can activate the sensor component by placing an object proximate the sensor component to activate the motor unit so that the motor unit rotates the dispenser head, with the compression apparatus compressing the container of the viscous substance such that the viscous substance is pressed out of the container and through the dispenser head and the hole in the front portion of the housing to be dispensed upon the object.

2. An automatic dispenser as set forth in claim 1, wherein the compression apparatus includes a spring for compressing a container of the viscous substance.

3. An automatic dispenser as set forth in claim 2, wherein the dispenser head further comprises a rotating cylinder with a diagonal and continuous opening which directs the flow of the viscous substance from the container of viscous substance to the hole in the front portion of the housing to be dispensed upon an object.

4. An automatic dispenser as set forth in claim 3, wherein the housing further comprises a controller connected with the motor unit, the controller being operable to allow a user to manually set an amount of time that the motor unit is activated to dispense a set amount of the viscous substance upon an object.

5. An automatic dispenser as set forth in claim 4, wherein the dispenser head further comprises a teeth portion and the motor unit further comprises a teeth portion, the teeth portions being formed such that the teeth portion of the motor unit interlink with the teeth portion of the dispenser head, thereby allowing the motor unit to rotate the dispenser head when the motor unit is activated by the sensor component.

6. An automatic dispenser as set forth in claim 5, wherein the housing has a shape, with the shape being formed to simulate an item selected from a group consisting of a house, a car, and a nightlight.

7. An automatic dispenser as set forth in claim 1, wherein the dispenser head further comprises a rotating cylinder with a diagonal and continuous opening which directs the flow of the viscous substance from the container of viscous substance to the hole in the front portion of the housing to be dispensed upon an object.

8. An automatic dispenser as set forth in claim 1, wherein the housing further comprises a controller connected with the motor unit, the controller being operable to allow a user to manually set an amount of time that the motor unit is activated to dispense a set amount of the viscous substance upon an object.

9. An automatic dispenser as set forth in claim 1, wherein the dispenser head further comprises a teeth portion and the motor unit further comprises a teeth portion, the teeth portions being formed such that the teeth portion of the motor unit interlink with the teeth portion of the dispenser head, thereby allowing the motor unit to rotate the dispenser head when the motor unit is activated by the sensor component.

10. An automatic dispenser as set forth in claim 1, wherein the housing has a shape, with the shape being formed to simulate an item selected from a group consisting of a house, a car, and a nightlight.

11. An automatic dispenser as set forth in claim 1, wherein the housing further comprises a toothbrush holder for holding a toothbrush.

12. An automatic dispensing apparatus, comprising:

a housing having a front portion, wherein the housing is capable of holding a container of a viscous substance proximate to the front portion, and the front portion further comprising a hole therethrough;

a sensor component attached with the front portion of the housing;

a compression apparatus that is connectable with the housing, the compression apparatus being operative for compressing the container of the viscous substance;

a dispenser head attached with the housing proximate the front portion, wherein the dispenser head is capable of attaching with the container of the viscous substance;

a motor unit connected with the sensor component and the dispenser head;

wherein the compression apparatus includes a spring for compressing a container of the viscous substance;

wherein the dispenser head further comprises a rotating cylinder with a diagonal and continuous opening which directs the flow of the viscous substance from the container of viscous substance to the hole in the front portion of the housing to be dispensed upon an object;

wherein the housing further comprises a controller connected with the motor unit, the controller being operable to allow a user to manually set an amount of time that the motor unit is activated to dispense a set amount of the viscous substance upon an object;

wherein the dispenser head further comprises a teeth portion and the motor unit further comprises a teeth portion, the teeth portions being formed such that the teeth portion of the motor unit interlink with the teeth portion of the dispenser head, thereby allowing the motor unit to rotate the dispenser head when the motor unit is activated by the sensor component;

wherein the housing has a shape, with the shape being formed to simulate an item selected from a group consisting of a house, a car, and a nightlight; and wherein the housing further comprises a toothbrush holder for holding a toothbrush, whereby a user can activate the sensor component by placing an object proximate the sensor component to activate the motor unit so that the motor unit rotates the dispenser head, with the compression apparatus compressing the container of the viscous substance such that the viscous substance is pressed out of the container and through the dispenser head and the hole in the front portion of the housing to be dispensed upon the object.

13. A method for forming an automatic dispensing apparatus, comprising acts of:

forming a housing having a front portion, wherein the housing is formed such that it is capable of holding a container of a viscous substance proximate to the front portion, and the front portion further comprising a hole therethrough;

attaching a sensor component with the front portion of the housing;

forming a compression apparatus that is connectable with the housing, the compression apparatus being operative for compressing the container of the viscous substance;

attaching a dispenser head with the housing proximate the front portion, wherein the dispenser head is capable of attaching with the container of the viscous substance; and connecting a motor unit with the sensor component and the dispenser head, whereby a user can activate the sensor component by placing an object proximate the sensor component to activate the motor unit so that the motor unit rotates the dispenser head, with the compression apparatus compressing the container of the viscous substance such that the viscous substance is pressed out of the container and through the dispenser head and the hole in the front portion of the housing to be dispensed upon the object.

14. A method as set forth in claim 13, further comprising an act of forming the dispenser head to include a rotating cylinder with a diagonal and continuous opening which directs the flow of the viscous substance from the container of viscous substance to the hole in the front portion of the housing to be dispensed upon an object.

15. A method as set forth in claim 13, further comprising an act of connecting a controller with the motor unit, the controller being operable to allow a user to manually set an amount of time that the motor unit is activated to dispense a set amount of the viscous substance upon an object.

16. A method as set forth in claim 13, further comprising an act of forming both the dispenser head and motor unit to each include teeth portions, the teeth portions being formed such that the teeth portion of the motor unit interlink with the teeth portion of the dispenser head, thereby allowing the motor unit to rotate the dispenser head when the motor unit is activated by the sensor component.

17. A method as set forth in claim 13, further comprising an act of forming the housing have a shape, with the shape being formed to simulate an item selected from a group consisting of a house, a car, and a nightlight.

18. A method as set forth in claim 13, further comprising an act of forming the housing to include a toothbrush holder for holding a toothbrush.

19. A method as set forth in claim 13, further comprising an act of forming the compression apparatus to include a spring for compressing a container of the viscous substance.

* * * * *